US010827812B2

(12) United States Patent
Reh et al.

(10) Patent No.: US 10,827,812 B2
(45) Date of Patent: Nov. 10, 2020

(54) PIECE OF BAGGAGE

(71) Applicant: RIMOWA Electronic Tag GmbH, Hamburg (DE)

(72) Inventors: Jan Reh, Hamburg (DE); Dieter Morszeck, Cologne (DE)

(73) Assignee: RIMOWA Electronic Tag GmbH, Hamburg (DE)

( * ) Notice: Subject to any disclaimer, the term of this patent is extended or adjusted under 35 U.S.C. 154(b) by 4 days.

(21) Appl. No.: 15/370,370

(22) Filed: Dec. 6, 2016

(65) Prior Publication Data

US 2017/0079398 A1 Mar. 23, 2017

Related U.S. Application Data

(63) Continuation of application No. PCT/EP2016/063603, filed on Jun. 14, 2016.

(30) Foreign Application Priority Data

Jun. 15, 2015 (EP) ..... 15172184

(51) Int. Cl.

| | |
|---|---|
| ***A45C 15/00*** | (2006.01) |
| ***A45C 13/42*** | (2006.01) |
| ***A45C 5/03*** | (2006.01) |
| ***A45C 5/14*** | (2006.01) |
| ***A45C 13/36*** | (2006.01) |

(52) U.S. Cl.

CPC ..... *A45C 15/00* (2013.01); *A45C 5/03* (2013.01); *A45C 13/42* (2013.01); *A45C 5/14* (2013.01); *A45C 13/36* (2013.01); *A45C 2005/037* (2013.01)

(58) Field of Classification Search

CPC .. A45C 15/00; A45C 5/03; A45C 5/14; A45C 13/262; A45C 5/146; A45C 13/385; A45C 3/004; A45C 13/42; A45C 13/36; A45C 2005/037

USPC ..... 190/18 A, 18 R, 124; 177/180, 238, 131, 177/148, 245; 40/5; 340/10.1; 29/700

See application file for complete search history.

(56) References Cited

U.S. PATENT DOCUMENTS 2,433,870 A * 1/1948 Socke ..... B65D 25/2826 16/405
2,648,412 A * 8/1953 Meyers ..... A45C 3/001 190/112
3,294,206 A * 12/1966 Gehrie ..... E05B 65/52 190/121

(Continued)

FOREIGN PATENT DOCUMENTS

BE 1010939 A7 3/1999
CN 103844534 A 6/2014

(Continued)

OTHER PUBLICATIONS

International Search Report dated Sep. 14, 2016 in corresponding Application No. PCT/EP2016/063603; 10 pgs.

(Continued)

*Primary Examiner* — Tri M Mai

(74) *Attorney, Agent, or Firm* — Maier & Maier, PLLC

(57) ABSTRACT

A piece of baggage including a body of the piece of baggage, two longitudinal sides, two main surfaces, an upper and a lower side. At least at one of the longitudinal sides includes a display is integrated in the body.

6 Claims, 6 Drawing Sheets

(56) References Cited

U.S. PATENT DOCUMENTS

| | | | | | |
|---|---|---|---|---|---|
| 3,432,012 | A * | 3/1969 | Winter | A45C 5/02 | 190/122 |
| 3,433,870 | A * | 3/1969 | Gutman | C07F 9/1651 | 514/120 |
| 3,447,195 | A * | 6/1969 | Bush | A45C 13/22 | 16/405 |
| 5,243,453 | A * | 9/1993 | Kawaguchi | D06F 34/28 | 349/60 |
| 5,409,152 | A * | 4/1995 | Trevino | A45C 15/00 | 224/259 |
| 5,500,636 | A * | 3/1996 | Mitchell | A45C 13/42 | 190/102 |
| 5,659,376 | A * | 8/1997 | Uehara | G02F 1/133308 | 348/794 |
| 7,151,231 | B2 * | 12/2006 | Kamakau | A45C 15/00 | 177/126 |
| 7,378,604 | B2 * | 5/2008 | Truong | A45C 13/28 | 177/131 |
| 7,481,231 | B2 * | 1/2009 | Litterst | A47L 15/241 | 134/111 |
| 2006/0054364 | A1 * | 3/2006 | Kamakau | G01G 19/58 | 177/180 |
| 2007/0107947 | A1 * | 5/2007 | Truong | A45C 13/28 | 177/131 |
| 2009/0242344 | A1 * | 10/2009 | Selvi | A45C 5/14 | 190/18 A |
| 2010/0018088 | A1 | 1/2010 | Rajpal | | |
| 2011/0100726 | A1 * | 5/2011 | Wu | A45C 13/28 | 177/132 |
| 2013/0043080 | A1 * | 2/2013 | Kritzler | G01G 19/58 | 177/132 |
| 2014/0151173 | A1 * | 6/2014 | Reh | A45C 13/42 | 190/18 A |

FOREIGN PATENT DOCUMENTS

| | | | | |
|---|---|---|---|---|
| CN | 103946872 | A | 7/2014 | |
| DE | 19818764 | A1 * | 6/1999 | A45C 5/02 |
| EP | 2737820 | A1 | 6/2014 | |
| TW | M497951 | U | 4/2015 | |
| WO | 2012152745 | A1 | 11/2012 | |

OTHER PUBLICATIONS

International Preliminary Report on Patentability dated Dec. 28, 2017 in corresponding Application No. PCT/EP2016/063603; 7 pgs.

Taiwanese Search Report dated Nov. 3, 2017, in connection with corresponding TW Application No. 105118467 (1 pg.).

Chinese Office Action dated Jul. 19, 2019, in connection with corresponding CN Application No. 201680034623.8 (10 pgs., including machine-generated English translation).

* cited by examiner

PIECE OF BAGGAGE

The invention relates to a piece of baggage according to the precharacterizing part of claim 1 as well as a method for manufacturing a piece of baggage according to claim 12.

In the case of the previously known pieces of baggage which are checked in at an air port for a flight, paper tags, so-called baggage tags, are glued to the piece of baggage, which indicate flight and personal data required for a flight, in particular forwarding routes and identification features.

Of late, it has been intended to provide so-called electronic baggage tags. Tags configured as electronic baggage tags and comprising a display are attached to the piece of baggage. However, there is a problem in that these tags comprising the displays are frequently damaged and are difficult to scan by the automatic scanners of the baggage forwarding means.

It is therefore an object of the present invention to provide electronic baggage tags which withstand high stresses and are very good to scan.

This object is achieved with the features of claims 1 and 12.

According to the invention, preferably at least at a longitudinal side of the body of the piece of baggage a display means is integrated in the body of the piece of baggage.

At the display means flight and personal data necessary for a flight can be adapted to be indicated.

The present invention offers the advantage that the display means configured as an electronic baggage tag is protected and is arranged at the piece of baggage, namely at the longitudinal side of the body of the piece of baggage, such that the display means is particularly good to scan.

The display means is arranged in a region where normally the paper baggage tags are arranged, namely at the longitudinal side of the body of the piece of baggage. Further, the display area of the display means may preferably be arranged in parallel to the longitudinal side such that the flight and personal data indicated in the display area of the display means are particularly good to scan.

The display means may be arranged in a well-type take-up element.

Due to the provision of this take-up element the display means is particularly well protected.

The take-up element may be arranged in a recess of the body of the piece of baggage and connected with the latter. The take-up element can thus enhance the rigidity of the body of the piece of baggage.

The take-up element may comprise an outer edge via which the take-up element is connected, preferably glued, to the body of the piece of baggage. Thus the stability of the body of the piece of baggage is further enhanced, whereby the display means is further protected.

Alternatively, the take-up element may be integrally formed with the body of the piece of baggage. The integrally formed well-type take-up element can also enhance the rigidity of the body of the piece of baggage and thus further protect the display means.

The take-up element may be deep-drawn in the body of the piece of baggage.

The display means may comprise a housing and a protective pane, wherein the display is arranged inside the housing such that the housing and the protective pane protect the display against impacts, bending, water and dust.

The housing and the protective pane thus form a closed system for the display means such that the latter is particularly well protected.

The protective pane can be made of a plastic material or glass.

The body of the piece of baggage may comprise a frame element for reinforcing the body of the piece of baggage in the region of the display means. Thus the protection of the display can be further enhanced.

The frame element may be arranged at least along the longitudinal side of the body of the piece of baggage.

The body of the piece of baggage may comprise a first and a second portion of the piece of baggage which are connected with each other via at least one hinge such that the body of the piece of baggage can be opened and closed, wherein the first and the second portion of the piece of baggage comprise edges which rest upon each other in the closed state.

The frame element may extend at least along one of the edges of the first and/or the second portion of the piece of baggage.

Starting from one of the edges, the take-up element may be adapted to be inserted into a recess arranged in the body of the piece of baggage.

Following the insertion of the take-up element, the frame element can be arranged along the edge.

The frame element may be adapted to be connected, preferably screwed, to the take-up element.

According to the present invention, further a method for manufacturing a piece of baggage including a body of the piece of baggage, two longitudinal sides, two main surfaces, an upper and a lower side may be provided, wherein a display means is accommodated in a take-up element arranged at the longitudinal side of the body of the piece of baggage.

A depression may be deep-drawn in the body of the piece of baggage. At least a portion of the depression may be stamped out such that a recess is produced, wherein the take-up element is arranged in the recess and is connected, preferably glued, to the body of the piece of baggage.

The display means may be introduced into the take-up element and screwed to the take-up element.

When the display means is screwed in place, an edge element of the display means may be pressed against the body of the piece of baggage, wherein preferably a sealing element is clamped between the display means and the body of the piece of baggage.

During the manufacture the take-up element can be inserted into a recess arranged in the body of the piece of baggage.

The body of the piece of baggage may be composed of a first and a second portion of the piece of baggage which are connected with each other via at least one hinge such that the body of the piece of baggage can be opened and closed, wherein the first and the second portion of the piece of baggage comprise edges which rest upon each other in the closed state.

Starting from an edge of the first or the second portion of the piece of baggage the take-up element may be inserted into the recess arranged in the body of the piece of baggage.

Following the insertion of the take-up element, the frame element can be arranged along the edge.

The frame element may be connected, preferably screwed, to the take-up element.

Hereunder exemplary embodiments of the invention are illustrated in detail with reference to the drawings.

Figure 4:
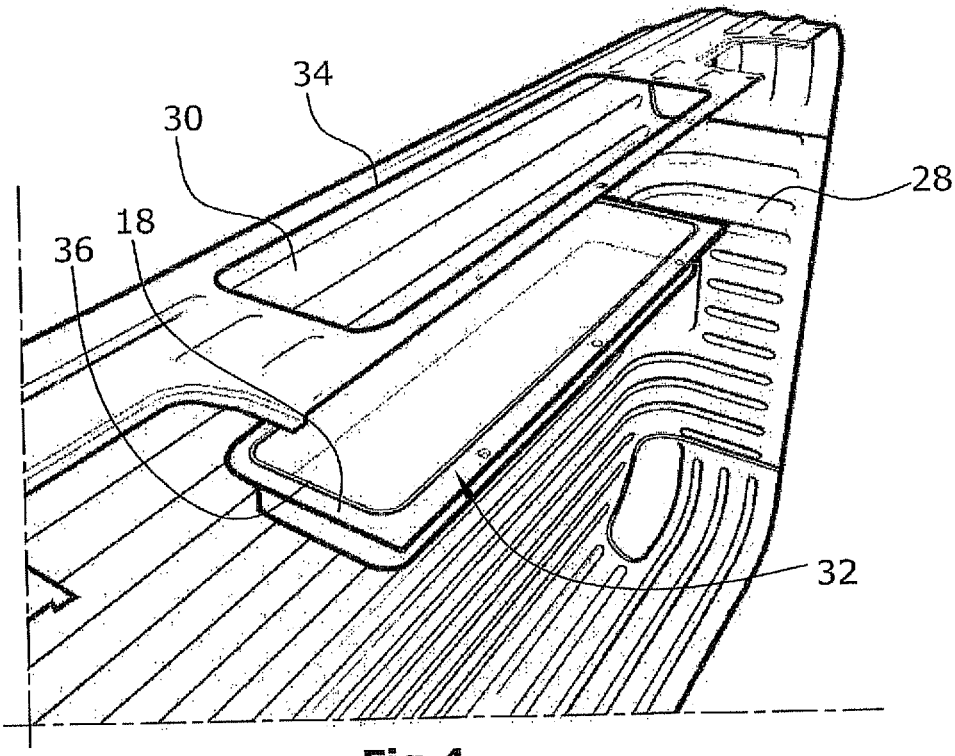
Figure 5:
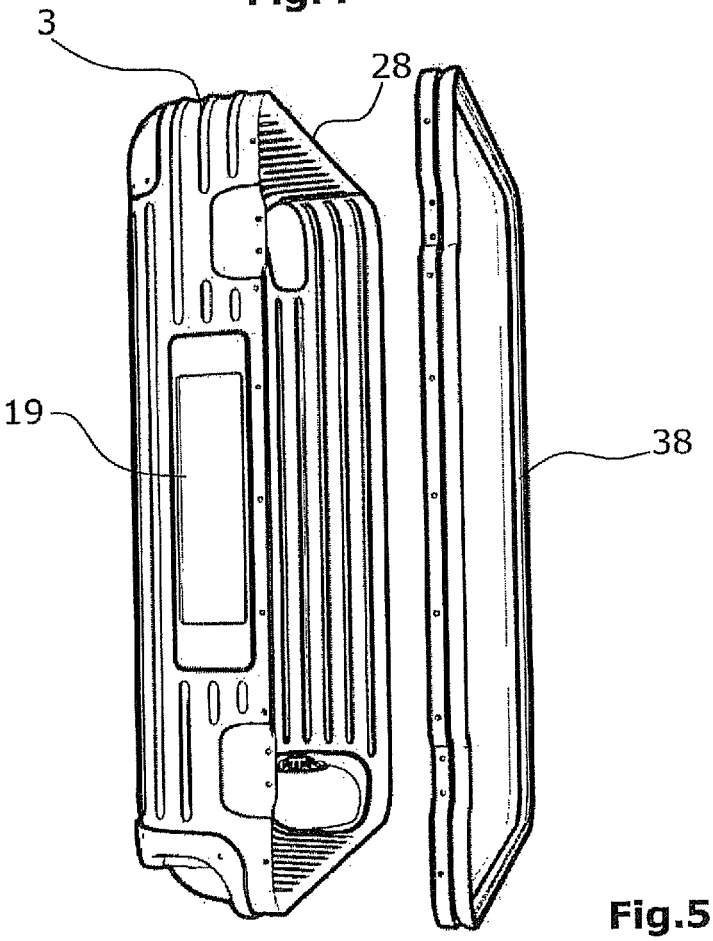
Figure 6:
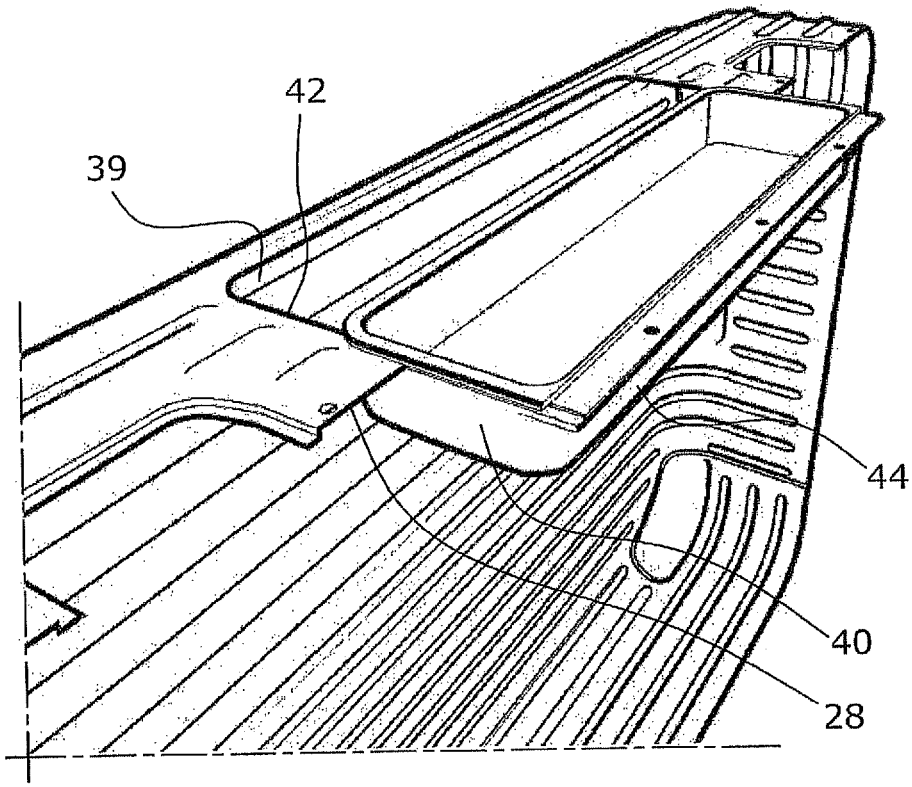
Figure 7:
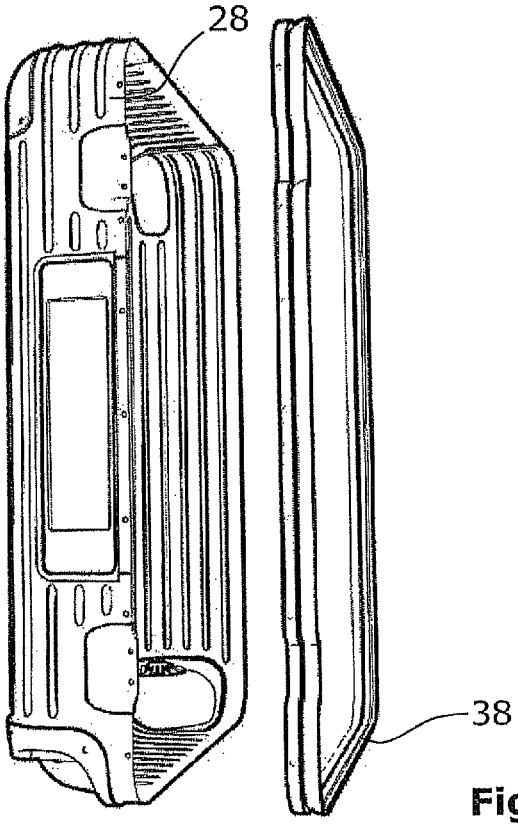
Figure 8:
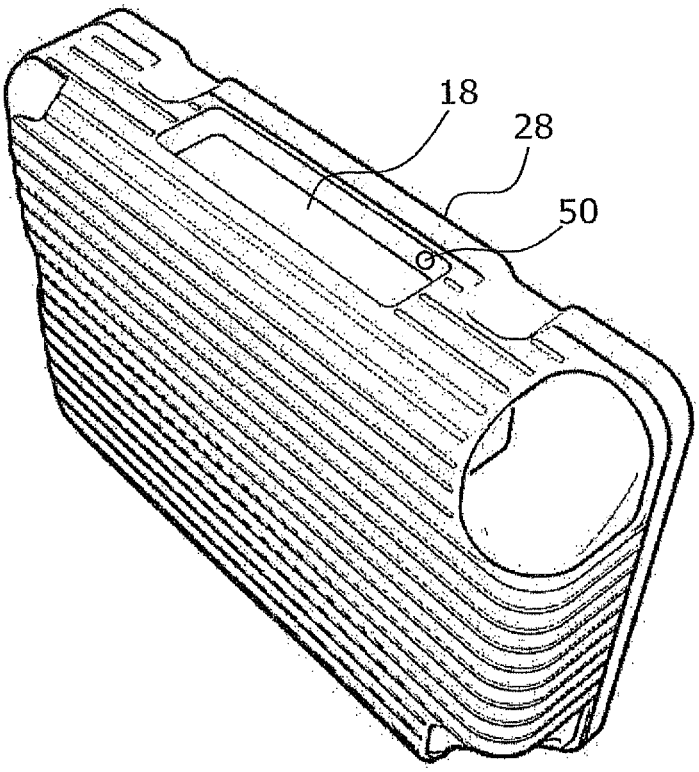
Figure 9:
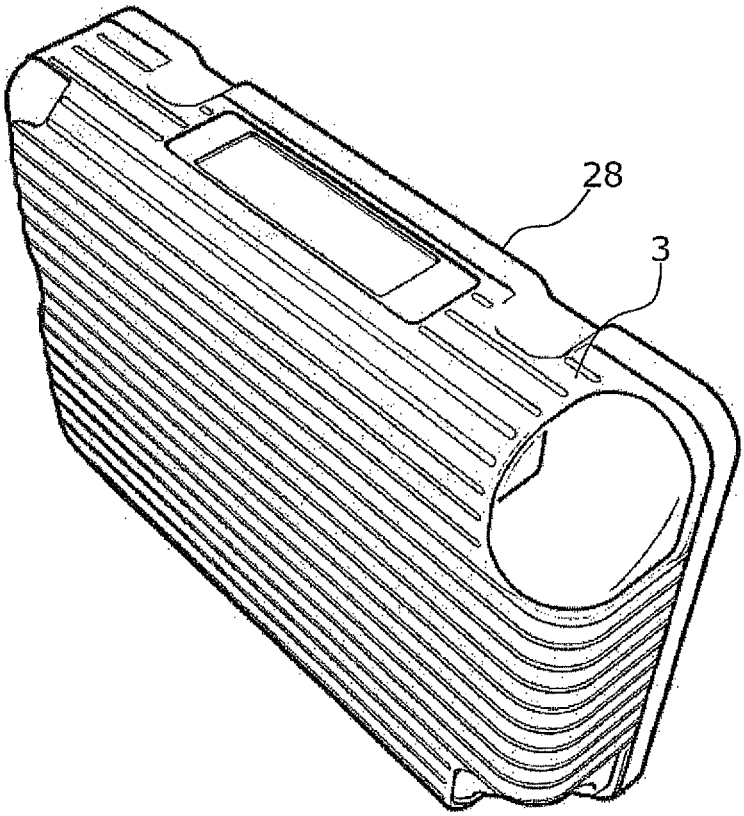
Figure 10:
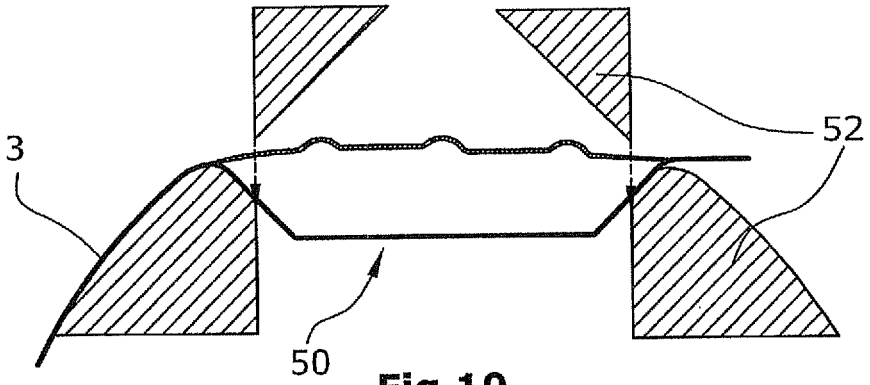
Figure 11:
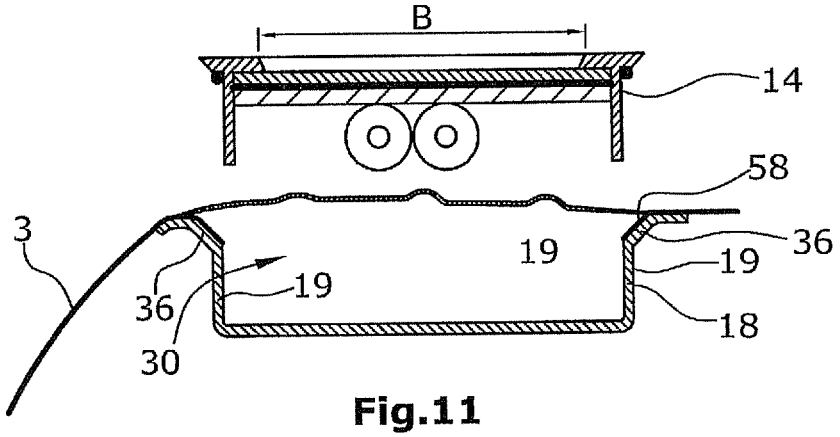
Figure 12:
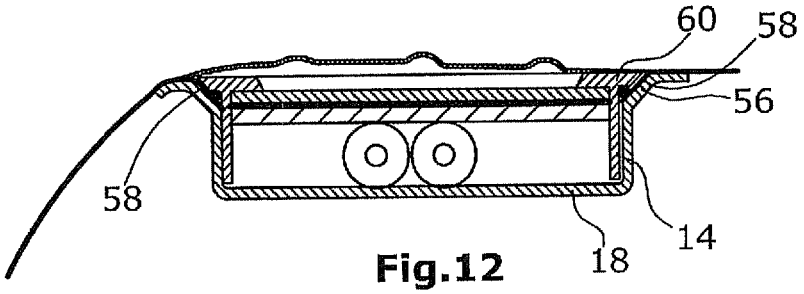
Figure 13:
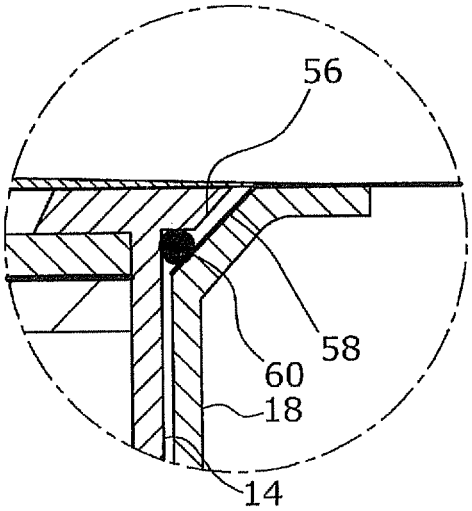

FIG. 4 shows a first portion of the body of the piece of baggage including a recess for the take-up element, FIG. 5 shows the portion of the piece of baggage of FIG. 4 where a frame element is added, FIG. 6 shows a portion of the piece of baggage where a take-up element is inserted, FIG. 7 shows the portion of the piece of baggage of FIG. 6 where a frame element is added, FIG. 8 shows a portion of the piece of baggage including a deep-drawn take-up element, FIG. 9 shows the portion of the piece of baggage of FIG. 8 with the display means inserted, FIG. 10 shows a body of the piece of baggage including a deep-drawn recess, FIG. 11 shows a body of the piece of baggage of FIG. 10 with the take-up element inserted, FIG. 12 shows a take-up element of FIG. 11 where the display means has been inserted, FIG. 13 shows a detail of FIG. 12.

Figure 1:
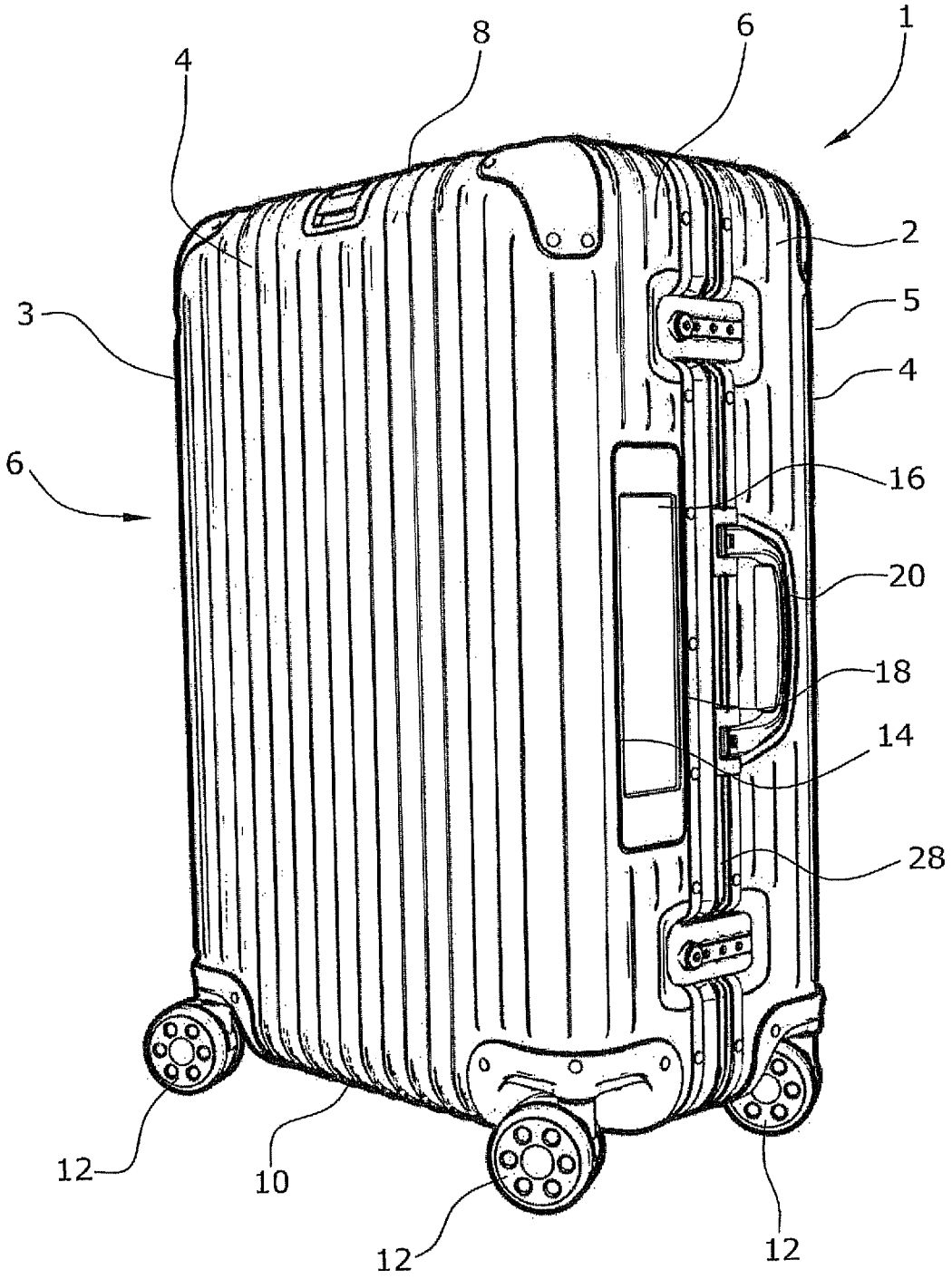
FIG. 1 shows a piece of baggage including a display means.

FIG. 1 shows a piece of baggage 1 comprising a body 2 of the piece of baggage. The body 2 of the piece of baggage comprises two main surfaces 4, two longitudinal sides 6 as well as an upper side 8 and a lower side 10. At the lower side 10 rollers 12 are arranged via which the piece of baggage 1 is adapted to be moved. At least at one longitudinal side 6 of the body 2 of the piece of baggage a display means 14 is integrated in the body 2 of the piece of baggage.

The display means 14 comprises a display area 16 which extends in parallel to the longitudinal side 6.

The display means 14 is arranged in a well-type take-up element 18. In the display area 16 of the display means 14 flight and personal data required for a flight are adapted to be represented.

The display means 14 is configured as an electronic tag. The flight and personal data required for the flight can be transmitted from a check-in means to the display means and graphically represented in the display area 16 of the display means 14. The display means 14 is arranged at the longitudinal side 6 where the handle 20 is disposed. Thus the flight and personal data represented at the display means 14 are arranged at a place similar to that of a conventional paper baggage tag which is normally attached to the handle 20.

Figure 2:
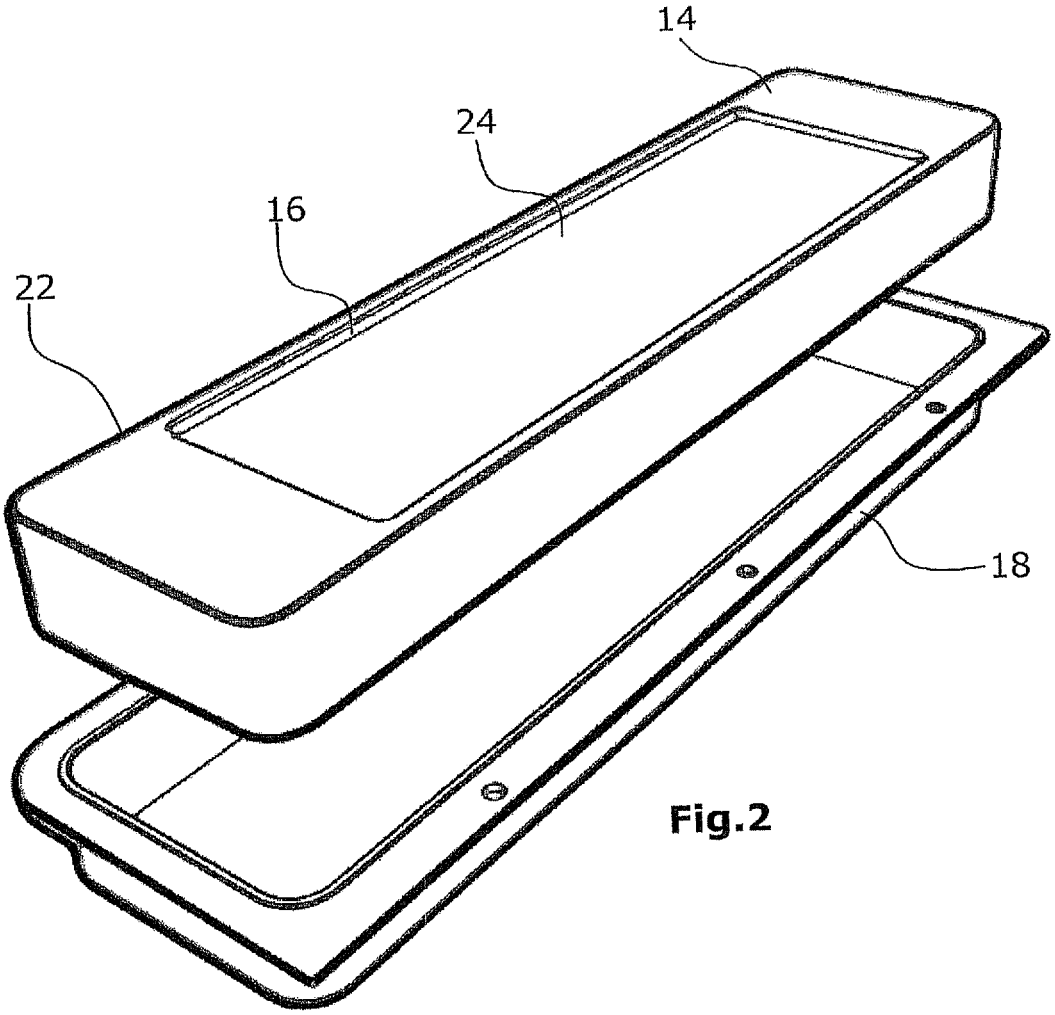
FIG. 2 shows the display means and the take-up element.
Figure 3:
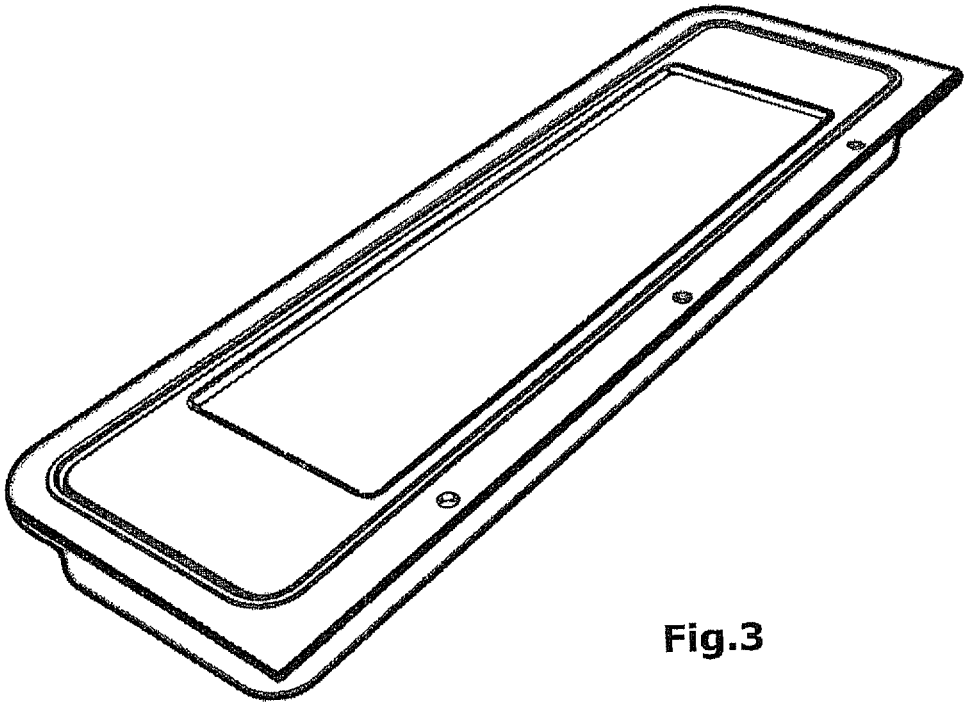
FIG. 3 shows the take-up element with the display means inserted.

In FIG. 2 the well-type take-up element 18 is illustrated in greater detail. Preferably, the take-up element 18 can be made of a plastic material. Alternatively, the take-up element can be made of any other material. The display means 14 comprises a housing 22 and a protective pane 24. Inside the housing 22 a display is arranged. The housing 22 and the protective pane 24 protect the display arranged inside against impacts, bending, water and dust. The housing 22 and the protective pane 24 thus form a closed system. This offers the advantage that that it is very difficult to tamper with the display.

The display means 14 may be arranged in the take-up element 18. The display means 14 may be accommodated in the take-up element 18 such that the display means 14 is arranged in the take-up element 18 in a slightly depressed manner such that the display means 14 is better protected against external influences.

Further, inside the display means 14 receiving means may be arranged with the aid of which data that can be indicated at the display means are received. The display means 14 comprises a region next to the display area 16 where the receiving means can be arranged such that the receiving means can be disposed directly on the surface of the display means 14 thus allowing for good transmission.

The body 2 of the piece of baggage comprises a first portion 3 of the piece of baggage and a second portion 5 of the piece of baggage which are connected with each other via at least one hinge such that the body 2 of the piece of baggage can be opened and closed, wherein the first and the second portion 3, 5 of the piece of baggage comprise edges 28 which rest upon each other in the closed state. In FIG. 4 the first portion 3 of the piece of baggage is shown. In the first portion 3 of the piece of baggage a recess 30 is provided into which the take-up element 18 can be introduced. The take-up element 18 comprises a circumferential edge 32 which can be inserted into the opening 30 and bears upon the edge 34 of the opening. The take-up element 18 comprises an outer edge 36 via which the take-up element 18 is connected with the body 2 of the piece of baggage and/or with the first portion 3 of the body 2 of the piece of baggage. Preferably, the outer edge 36 is glued to the body 2 of the piece of baggage and thus the portion 3 of the piece of baggage can be particularly well reinforced and the take-up element offers a particularly good protection for the display means.

In FIG. 5 the first portion 3 of the piece of baggage of FIG. 4 is illustrated. After the take-up element 18 has been connected with the first portion 3 of the piece of baggage, a frame element 38 for reinforcing the body 2 of the piece of baggage may be provided. Preferably, the frame element 38 may be provided in the region of the display means 14 and/or in the region of the take-up element 18. In the illustrated exemplary embodiment, the frame element 38 is provided along the entire circumferential edge 28 of the first portion 3 of the piece of baggage. Thus the first portion 3 of the piece of baggage can be reinforced in particular in the region of the display means 14 and thus the display means can be protected against bending, impacts and other external influences.

In FIG. 6 an alternative exemplary embodiment is illustrated. FIG. 6 also illustrates the first portion of the piece of baggage where a recess is arranged. However, this recess extends up to the edge 28. In the illustrated exemplary embodiment, the take-up element 18 comprises a circumferential groove 40. Via the circumferential groove the take-up element 18 can be inserted into the recess 38. Preferably, the edge 42 of the recess is clamped into the groove 40.

FIG. 7 shows how the take-up element 18 of FIG. 6 is inserted into the recess 38. The edge 44 of the take-up element is flush with the edge 28 of the first portion of the piece of baggage. Next, a frame element is arranged along the edge 28. Again, the illustrated frame element 38 is arranged along the entire edge 28 of the first portion 3 of the piece of baggage. Alternatively, the frame element may be arranged only in the region of the take-up element 18.

In FIG. 8 another alternative exemplary embodiment is illustrated. In FIG. 8 a first portion of the piece of baggage is illustrated where the take-up element 18 is integrally formed with the first portion 3 of the piece of baggage and thus with the body 2 of the piece of baggage. Preferably, the take-up means 18 is deep-drawn in the body 2 of the piece of baggage. The display element 14 may be inserted into the take-up element 18.

Preferably, a recess 50 is provided in the take-up element 18, via which recess an actuating means, such as a button which is also arranged at the display means, can extend through the take-up element 18. The take-up elements of FIGS. 2-6 may also comprise such a recess for an actuating element.

With the aid of the actuating means the display means 18 may be made ready-to-receive and the display means may receive data, in particular fight and personal data, and indicate them in the display area. Preferably, the display of the display means is a currentless display which merely requires current for the initial indication of the data but not for the permanent indication of the data. Such displays are also referred to as bistable displays.

FIGS. 10 to 13 show another alternative exemplary embodiment. In FIG. 10 a detail of a portion 3 of the piece of baggage is shown. In the portion of the piece of baggage a depression has been deep-drawn. A portion of the depression is stamped out with the aid of the stamping tools 52 such that a recess 30 is produced. An outer edge 36 of the well-type take-up element 18 is glued from below to the portion 3 of the piece of baggage. The edge region of the portion 3 of the piece of baggage and the outer edge 36 are inclined with respect to the remaining portion of the piece of baggage and further with respect to the remaining portion of the take-up element 18. In particular, they are inclined with respect to the side walls 19 of the take-up element 18. FIG. 11 illustrates how the take-up element is glued to the portion 3 of the piece of baggage and thus to the body 2 of the piece of baggage. However, other types of connection than gluing may be chosen.

FIG. 12 illustrates how the display means 14 is introduced into the take-up element 18. The display means may be connected, preferably screwed, to the take-up element. During the screwing process an edge element 56 of the display means 14 is pressed against the body 2 of the piece of baggage and/or the edge region 58 of the body 2 of the piece of baggage. Preferably, a sealing element 60 is clamped between the display means 14 and the body 2 of the piece of baggage. Thus the display means is connected with the take-up element 18 in an air- and dust-tight manner.

The invention claimed is:

1. A piece of baggage comprising:

a body of the piece of baggage comprising a first portion having a first portion edge and a second portion having a second portion edge, the first portion edge and second portion edge being adjacent when in a closed position;

a frame element for reinforcing said body of the piece of baggage;

two longitudinal sides;

two main surfaces;

an upper and a lower side, wherein at said lower side rollers are arranged via which said piece of baggage is adapted to be moved;

wherein at least at one longitudinal side of said body of the piece of baggage is a scannable display configured as an electronic baggage tag integrated in said body of the piece of baggage, the display configured to receive required flight and personal data from a check-in device and display the required flight and personal data on the display; and a take-up element that receives and secures the display such that a seal is mechanically formed between a circumferential edge of the display and the take-up element, wherein the first portion has a recess disposed therein, the recess extending to the first portion edge, wherein the take-up element comprises a circumferential groove configured to slidably receive a recess edge, wherein a take-up element edge aligns with the first portion edge when the take-up element is inserted in the recess, and wherein the frame element is secured to the first portion proximate the first portion edge and to the take-up element proximate the take-up element edge.

2. The piece of baggage according to claim 1, wherein the take-up element is arranged in a recess of the body of the piece of baggage and connected with the latter.

3. The piece of baggage according to claim 2, wherein the take-up element comprises an external edge via which said take-up element is connected to the body of the piece of baggage.

4. The piece of baggage according to claim 1, wherein the display includes a housing and a protective pane, wherein the display is arranged inside said housing such that said housing and said protective pane protect said display against impacts, bending, water and dust.

5. The piece of baggage according to claim 1, wherein the frame element is arranged along at least the longitudinal side of the body of the piece of baggage.

6. The piece of baggage according to claim 1, wherein the first and the second portion of the piece of baggage are connected with each other via at least one hinge such that said body of the piece of baggage can be opened and closed.

* * * * *